US011274470B2

(12) United States Patent
Arlinghaus et al.

(10) Patent No.: US 11,274,470 B2
(45) Date of Patent: Mar. 15, 2022

(54) MOTORIZED TRIM

(71) Applicant: Schlage Lock Company LLC, Carmel, IN (US)

(72) Inventors: Paul R. Arlinghaus, Fishers, IN (US); Jack R. Lehner, Jr., Indianapolis, IN (US); David V. Toloday, Martinsville, IN (US); Suresha Chandrasekhara, Bangarpet Taluk (IN); John Stalter, Indianapolis, IN (US); Marlin Austin, Speedway, IN (US)

(73) Assignee: Schlage Lock Company LLC, Carmel, IN (US)

( * ) Notice: Subject to any disclaimer, the term of this patent is extended or adjusted under 35 U.S.C. 154(b) by 596 days.

(21) Appl. No.: 16/265,116

(22) Filed: Feb. 1, 2019

(65) Prior Publication Data

US 2020/0248480 A1 Aug. 6, 2020

(51) Int. Cl.
*E05B 47/06* (2006.01)
*E05B 47/00* (2006.01)

(52) U.S. Cl.
CPC ..... *E05B 47/0607* (2013.01); *E05B 47/0001* (2013.01); *E05B 47/0012* (2013.01); *E05B 47/0603* (2013.01); *E05Y 2900/132* (2013.01)

(58) Field of Classification Search
CPC ..... E05B 47/0607; E05B 47/0001; E05B 47/0012; E05B 47/0603; E05B 47/0669; E05B 47/0673
See application file for complete search history.

(56) References Cited

U.S. PATENT DOCUMENTS 4,961,330 A 10/1990 Evans
5,584,515 A 12/1996 Silye
5,628,216 A 5/1997 Qureshi et al.
5,802,894 A 9/1998 Jahrsetz et al.
5,823,582 A 10/1998 Frolov et al.
(Continued)

OTHER PUBLICATIONS

Sargent ASSA ABLOY; Electronic Access Control Product Bulletin; A Revolutionary Advancement in Electrified Exit Trims; Feb. 2018; 1 page; Copyright 2009-2018 Sargent Manufacturing Company, an ASSA ABLOY Group company.
(Continued)

*Primary Examiner* — Kristina R Fulton
*Assistant Examiner* — James E. Ignaczewski
(74) *Attorney, Agent, or Firm* — Taft Stettinius & Hollister LLP

(57) ABSTRACT

An exemplary trim assembly comprises a housing assembly, a cam rotatably mounted to the housing assembly, a lift finger slidably mounted in the housing assembly such that the cam is operable to linearly drive the lift finger between a deactuated position and an actuated position, and a locking mechanism operable to selectively retain the lift finger in the deactuated position. The locking mechanism includes an interface member engaged with the lift finger such that movement of the lift finger moves the interface member between a home position and an offset position, a blocking member operable to selectively prevent movement of the interface member from the home position, and a driver configured to move the blocking member between a blocking position and an unblocking position to thereby lock and unlock the trim assembly.

20 Claims, 9 Drawing Sheets

(56) References Cited

U.S. PATENT DOCUMENTS

| | | | | |
|---|---|---|---|---|
| 5,987,945 | A | 11/1999 | Ruano Aramburu | |
| 5,988,708 | A | 11/1999 | Frolov et al. | |
| 6,318,138 | B1 | 11/2001 | Mathews et al. | |
| 7,246,827 | B2 * | 7/2007 | Geringer | E05B 47/0669 292/144 |
| 7,536,885 | B1 | 5/2009 | Ross et al. | |
| 7,698,918 | B2 * | 4/2010 | Geringer | E05B 47/0676 70/278.7 |
| 7,918,117 | B2 | 4/2011 | Frolov et al. | |
| 8,480,136 | B2 | 7/2013 | Dye et al. | |
| 8,590,948 | B2 | 11/2013 | Shen | |
| 9,262,875 | B1 * | 2/2016 | Chen | E05B 65/0032 |
| 9,435,142 | B2 | 9/2016 | Carpenter et al. | |
| 9,567,773 | B2 | 2/2017 | Dore Vasudevan et al. | |
| 9,995,060 | B2 | 6/2018 | Miller et al. | |
| 10,060,158 | B2 | 8/2018 | Frolov et al. | |
| 2004/0227359 | A1 | 11/2004 | Coleman et al. | |
| 2007/0179729 | A1 | 7/2007 | Kaiser et al. | |
| 2012/0169453 | A1 * | 7/2012 | Bryla | E05B 47/00 340/3.1 |
| 2014/0020295 | A1 | 1/2014 | Bonahoom et al. | |
| 2014/0021843 | A1 | 1/2014 | Hashemi et al. | |
| 2015/0247345 | A1 * | 9/2015 | Carpenter | E05B 47/026 70/277 |
| 2015/0322696 | A1 | 11/2015 | Dudley | |
| 2017/0352216 | A1 | 12/2017 | Donovan | |
| 2018/0106077 | A1 | 4/2018 | Shen | |
| 2018/0245372 | A1 | 8/2018 | Pfunder et al. | |
| 2018/0245375 | A1 | 8/2018 | Arlinghaus et al. | |
| 2018/0283050 | A1 | 10/2018 | Miller et al. | |
| 2019/0066413 | A1 | 2/2019 | McLeod et al. | |

OTHER PUBLICATIONS

Sargent ASSA ABLOY; EcoFlex Technology; Feb. 2018; 2 pages; Copyright 2018 Sargent Manufacturing Company, as ASSA ABLOY Group company.

International Search Report; International Searching Authority; International Application No. PCT/US2020/016396; dated Aug. 11, 2020; 3 pages.

Written Opinion of the International Searching Authority, International Searching Authority; International Application No. PCT/US2020/016396; dated Aug. 11, 2020; 5 pages.

Von Duprin, E996L Series Installation Instructions, Electric Locking Trim, 921297-00, 8 pages, Copyright Allegion 2016.

* cited by examiner

MOTORIZED TRIM

TECHNICAL FIELD

The present disclosure generally relates to lockable handle sets, and more particularly but not exclusively relates to lockable trims for exit devices.

BACKGROUND

Pushbar exit devices are often installed to the inner side of a door to facilitate egress from a room. The outer side of such doors are frequently provided with a trim that connects to the pushbar assembly and enables operation of the exit device from the non-egress or outer side of the door. While certain existing exit device trims are provided with solenoid-actuated locking mechanisms, many such locking mechanisms have disadvantages and drawbacks, such as those related to power consumption and susceptibility to adverse weather conditions and tampering. For these reasons among others, there remains a need for further improvements in this technological field.

SUMMARY

An exemplary trim assembly comprises a housing assembly, a cam rotatably mounted to the housing assembly, a lift finger slidably mounted in the housing assembly such that the cam is operable to linearly drive the lift finger between a deactuated position and an actuated position, and a locking mechanism operable to selectively retain the lift finger in the deactuated position. The locking mechanism includes an interface member engaged with the lift finger such that movement of the lift finger moves the interface member between a home position and an offset position, a blocking member operable to selectively prevent movement of the interface member from the home position, and a driver configured to move the blocking member between a blocking position and an unblocking position to thereby lock and unlock the trim assembly. Further embodiments, forms, features, and aspects of the present application shall become apparent from the description and figures provided herewith.

DETAILED DESCRIPTION OF ILLUSTRATIVE EMBODIMENTS

Figure 1:
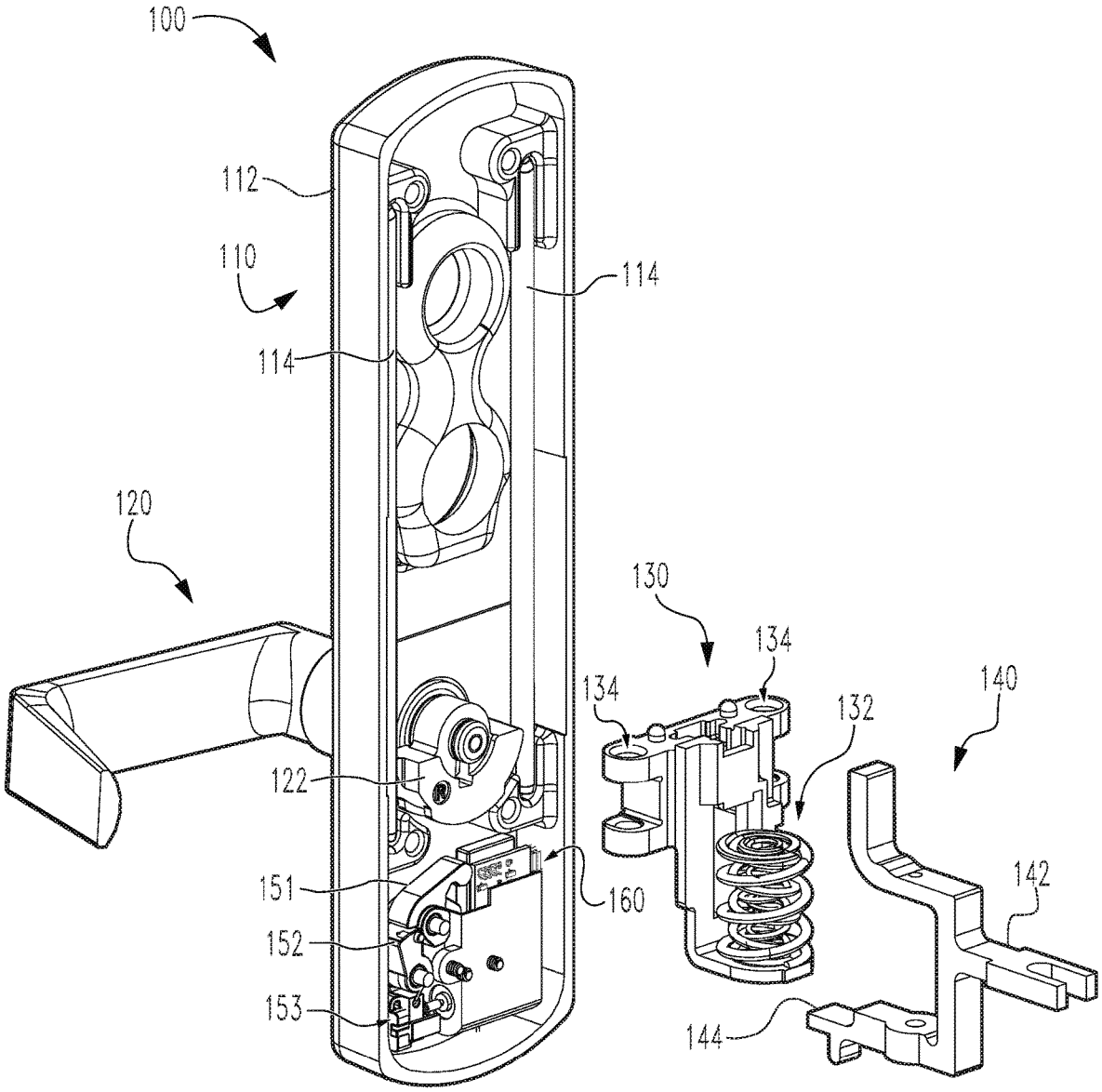
FIG. 1 is an exploded assembly view of a trim assembly according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is an electrified trim 100 according to certain embodiments. The trim 100 generally includes a housing assembly 110, a handle 120 rotatably mounted to the housing assembly 110, a slider 130 slidably mounted to the housing assembly 110, and a lift finger 140 engaged with the slider 130 via a spring mechanism 132. As described herein, rotation of the handle 120 causes a corresponding vertical movement of the slider 130, which in turn drives the lift finger 140 to actuate an associated exit device. The trim 100 further includes a locking mechanism 150 configured to selectively prevent movement of the lift finger 140 to lock the trim 100 against actuating the exit device, and a control assembly 160 configured to control operation of the locking mechanism 150.

The housing assembly 110 generally includes an escutcheon 112 configured for mounting to the door on which the exit device is installed. A pair of rails 114 is mounted in the escutcheon 112, and the slider 130 is slidably mounted to the rails 114. A pair of return springs 116 is mounted to the rails 114 such that the springs 116 bias the slider 130 toward a home position.

The handle 120 is rotatably mounted to the escutcheon 112 for movement between a home position and a pivoted position. A cam 122 is rotationally coupled to the handle 120 for joint rotation therewith. While the illustrated handle 120 is provided in the form of a lever, it is also contemplated that the handle 120 may instead be provided in the form of a knob.

The slider 130 is slidably mounted to the rails 114, each of which extends through a corresponding and respective pair of apertures 134. The slider 130 is engaged with the cam 122 such that rotation of the handle 120 in either direction from its home position causes the cam 122 to drive the slider 130 upward against the biasing force of the return springs 116. The springs 116 bias the slider 130 toward a home position, thereby biasing the handle 120 to a corresponding home position.

The lift finger 140 is movably mounted to the slider 130 and is engaged with the slider via the spring mechanism 132. The spring mechanism 132 includes one or more springs, and the stiffness of the spring mechanism 132 is sufficient to drive the lift finger 140 in an upward actuating direction when the slider 130 is lifted by the cam 122. Thus, rotation of the handle 120 from its home position to its pivoted position causes a corresponding movement of the lift finger 140 from a deactuated position to an actuated position. When the lift finger 140 is retained in its deactuated position by the locking mechanism 150, movement of the slider 130 in the actuating direction compresses the spring mechanism 132. The lift finger 140 includes an extension 142 that extends into and/or through the door to engage the exit device such that upward movement of the lift finger 140 actuates the exit device to retract a latchbolt, thereby permitting opening movement of the door. The lift finger 140 also includes a ledge 144 that interfaces with the locking mechanism 150 in the manner described hereinafter.

The locking mechanism 150 generally includes an interface member 151 operable to engage the lift finger 140, a blocking member 152 configured to selectively prevent movement of the interface member 151, and an actuator 153 engaged with the blocking member 152 via a spring. The interface member 151 is engaged with the ledge 144 such that movement of the lift finger 140 in the actuating direction causes a corresponding movement of the interface member 151 from a home position to an offset position. The blocking member 152 has a blocking position and an unblocking position, and is driven between the blocking position and the unblocking position by the actuator 153. In the blocking position, the blocking member 152 retains the interface member 151 in its home position, thereby preventing actuating movement of the lift finger 140, thereby locking the trim 100. In the unblocking position, the interface member 151 is free to move to its offset position, thereby permitting actuating movement of the lift finger 140 and unlocking the trim 100. The actuator 153 is in communication with the control assembly 160, which controls operation of the actuator 153.

Figure 2:
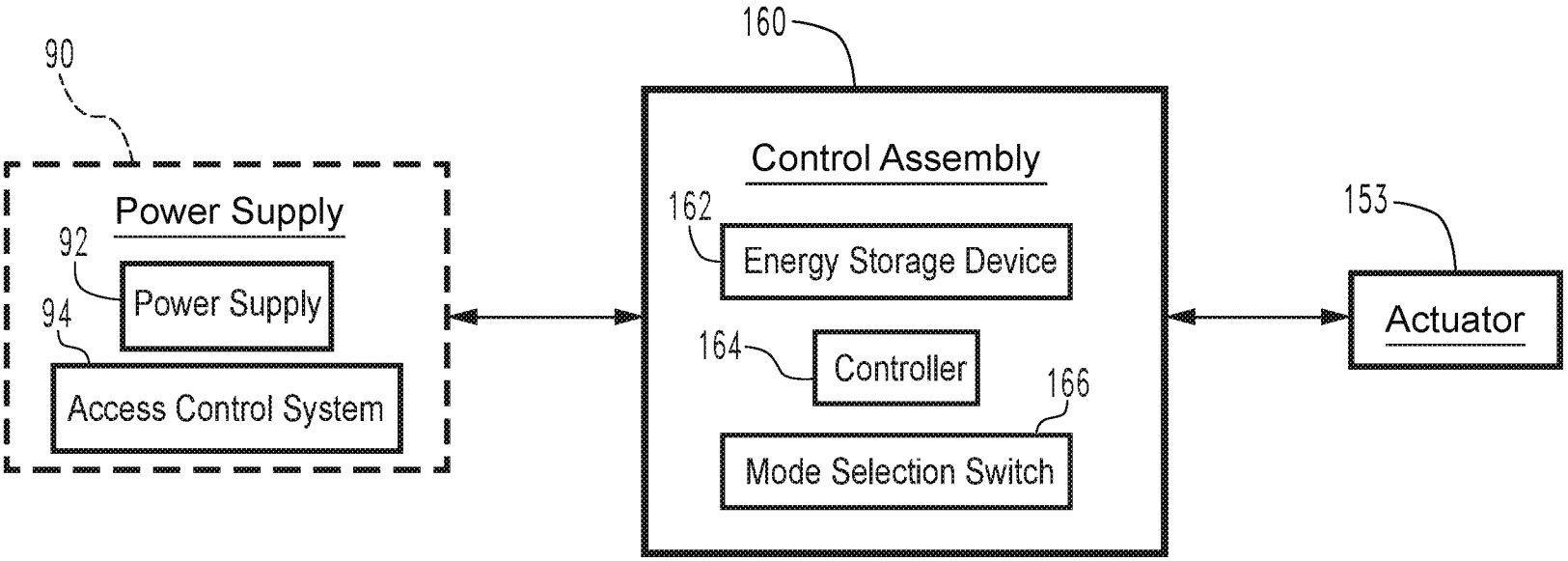
FIG. 2 is a schematic block diagram of a control assembly according to certain embodiments.

With additional reference to FIG. 2, the illustrated control assembly 160 includes an energy storage device 162 and a controller 164 connected with the energy storage device 162. The controller 164 is also connected with the actuator 153 such that the controller 164 is operable to cause actuation of the actuator 153 using electrical power stored in the energy storage device 162. In the illustrated form, the control assembly 160 is connected with an external system 90, such as an external power supply 92 and/or an access control system 94 operable to supply power to the control assembly 160.

The illustrated control assembly 160 further includes a mode selection switch 166, which sets the control assembly to operate in either of an electric locking (EL) or electric unlocking (EU) mode. In each mode, the control assembly 160 maintains the locking mechanism 150 in a first state (i.e., either the locking state or the unlocking state) while power is being received from the external system 90, and transitions the locking mechanism 150 a second state (i.e., the other of the locking state or the unlocking state) when power is cut. More particularly, when power is cut, the controller 164 actuates the actuator 153 using energy stored in the energy storage device 162 to cause the locking mechanism 150 to transition to the second state.

When power is subsequently reconnected to the control assembly 160, the controller 164 does not necessarily immediately return to the locking mechanism 150 to the first state. Instead, the controller 164 first ensures that the charge in the energy storage device 162 is sufficient to return the locking mechanism 150 to the second state when the power is removed. If the charge in the energy storage device 162 is insufficient, the controller 164 first charges the energy storage device 162 using the connected power. When the charge in the energy storage device 162 is sufficient to return the locking mechanism 150 to the second state, the controller 164 operates the actuator 153 using the connected power to drive the locking mechanism 150 to the first state.

As noted above, the illustrated control assembly 160 includes a mode selection switch 166 that controls the EL/EU operating mode for the control assembly 160. When the selection switch 166 is in the EL or fail safe position, the first state of the locking mechanism 150 is the locking state and the second state is the unlocking state. Thus, the control assembly 160 maintains the locking mechanism 150 in the locking state when power is connected (thereby electrically locking the trim 100), and transitions the locking mechanism 150 to the unlocking state when power is cut (thereby causing the trim to fail safe). When the selection switch 166 is in the EU or fail secure position, by contrast, the first state of the locking mechanism 150 is the unlocking state and the second state is the locking state. Thus, the control assembly 160 maintains the locking mechanism 150 in the unlocking state when power is connected (thereby electrically unlocking the trim 100), and transitions the locking mechanism 150 to the locking state when power is cut (thereby causing the trim to fail secure).

While the control assembly 160 has been described as being connected to an external system 90 that supplies power to the control assembly 160, it is also contemplated that the trim 100 may not necessarily be connected to such an external system 90. For example, the energy storage device 162 may be provided in the form of a battery, and the trim 100 may include a credential reader. In such forms, the control assembly 160 may control operation of the locking mechanism 150 based upon information received from the credential reader.

Figure 3:
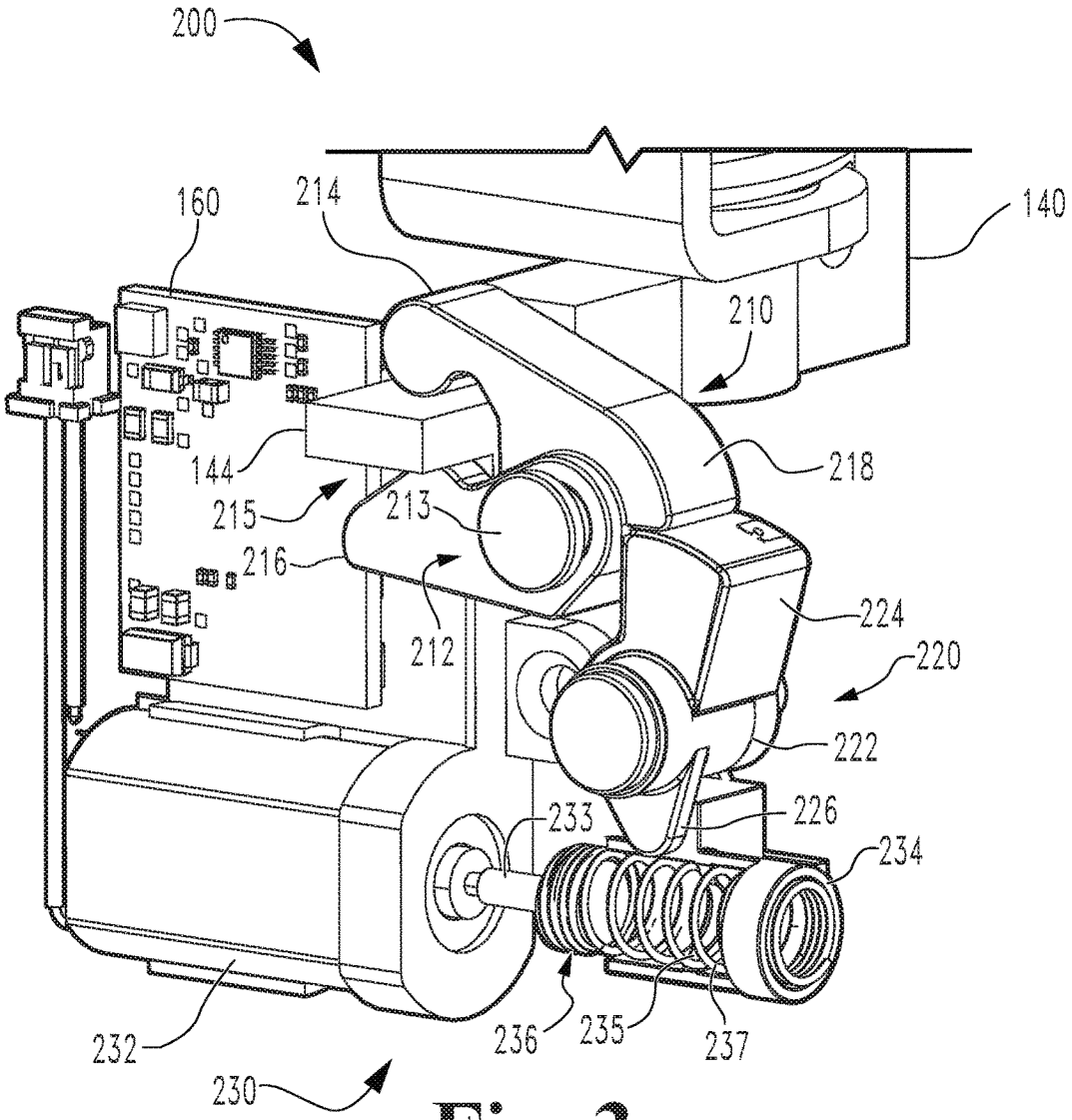
FIG. 3 is a perspective illustration of a locking mechanism according to certain embodiments while in a locking state.
Figure 4:
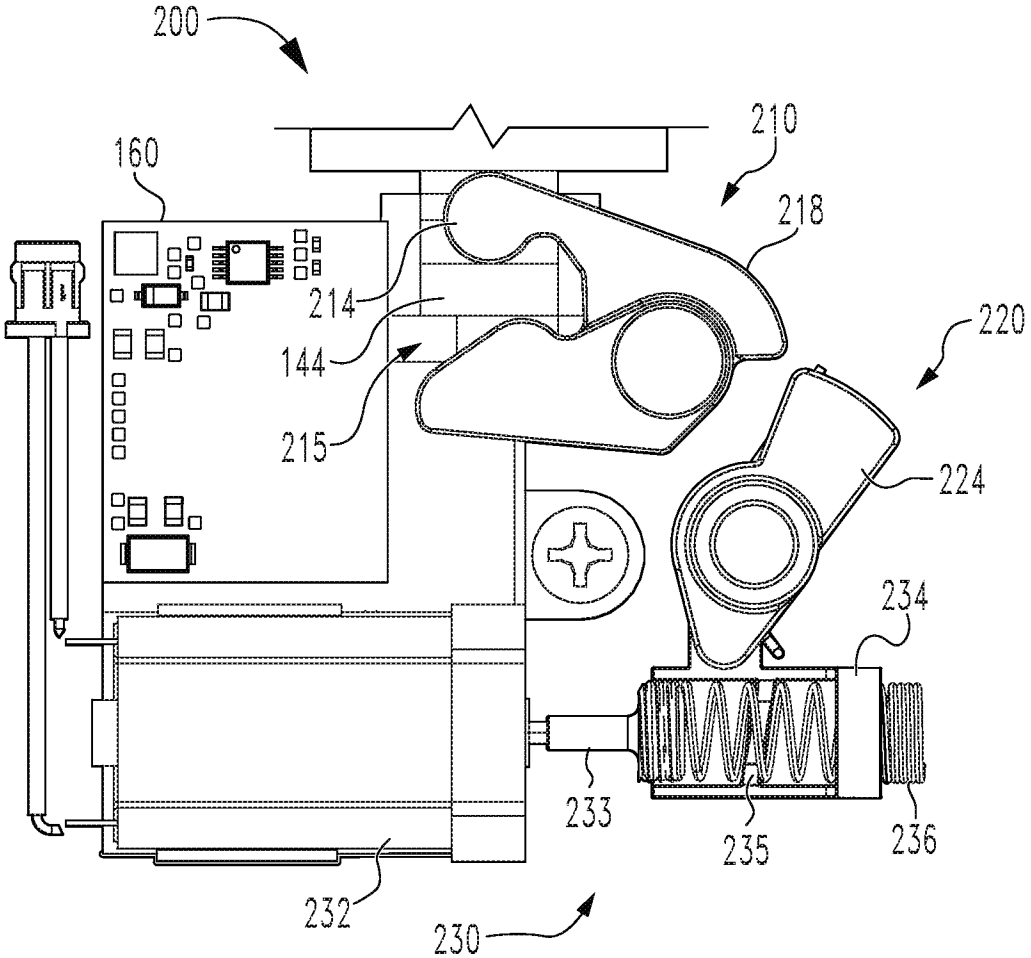
FIG. 4 is a plan view of the locking mechanism illustrated in FIG. 3 while in an unlocking state.

With additional reference to FIGS. 3 and 4, illustrated therein is a locking mechanism 200 according to certain embodiments. The locking mechanism 200 is one example of the locking mechanism 150, and its operation is controlled by the control assembly 160, for example in the manner described above. The locking mechanism 200 includes an interface member in the form of a pivoting fork member 210 operable to engage the lift finger 140, a blocking member 220 configured to selectively prevent movement of the fork member 210, and a driver 230 operable to drive the blocking member 220 between a blocking position and an unblocking position. In the interest of clarity, certain portions of the housing assembly 110 are omitted from the illustration of FIGS. 3 and 4. For example, an unillustrated mounting plate provides mounting locations for the pivotal mounting of the fork member 210 and the blocking member 220.

The fork member 210 is pivotably mounted within the escutcheon 112, and includes a body portion 212 through which a pivot pin 213 passes, a pair of prongs 214, 216 extending from a first side of the body portion 212, and a shoulder 218 extending from the opposite side of the body portion 212. A first prong 214 rests atop the ledge 144 when the lift finger 140 is in its deactuated position, and a second prong 216 is positioned on the opposite side of the ledge 144. Thus, when the lift finger 140 is in its deactuated position, the fork member 210 is in its home position, and the ledge 144 is received in a recess 215 between the prongs 214, 216. Movement of the lift finger 140 toward its actuated position causes the ledge 144 to exert an upward force on the first prong 214, thereby urging the fork member 210 toward a pivoted position. As the lift finger 140 returns to its deactuated position, the ledge 144 engages the second prong 216 to return the fork member 210 to its home position.

The blocking member 220 is pivotably mounted within the escutcheon 112, and includes a body portion 222 through which a pivot pin 223 passes, a blocking portion 224 extending from one side of the body portion 222, and an extension 226 extending from the opposite side of the body portion 222. The extension 226 is engaged with the driver 230 such that the driver 230 is operable to pivot the blocking member between its blocking position and its unblocking position.

The driver 230 is in communication with the control assembly 160, and includes an actuator 232 operable to move an output shaft 233, a link 234 engaged with the extension 226 of the blocking member 220, and a spring 236 engaged between the output shaft 233 and the link 234. The actuator 232 is operable to load the spring 236 to cause the spring 236 to exert forces on the link 234, and the link 234 is configured to transmit forces between the spring 236 and the blocking member 220. In the illustrated form, the spring 236 is provided in the form of a coil spring, the link 234 includes a projection 235 that is received between coils 237 of the coil spring 236, and the actuator 232 is configured to load the spring 236 by rotating the shaft 233. The actuator 232 may, for example, be provided in the form of a stepping motor. It is also contemplated that the actuator 232 may be a linear actuator configured to load the spring 236 by moving the shaft 233 linearly.

During operation, the locking mechanism 200 may begin in a locking state, in which the blocking member 220 is in the blocking position (FIG. 3). In this state, an attempt to move the lift finger 140 in the actuating direction causes the ledge 144 to urge the fork member 210 toward its offset or pivoted position as described above. This urging causes the shoulder 218 to engage the blocking portion 224 such that the blocking member 220 retains the fork member 210 in its home position, thereby preventing movement of the lift finger 140 toward its actuated position. As a result, the handle 120 is not operable to drive the lift finger 140 to actuate the exit device, and the trim assembly 100 is in a locked state.

In order to transition the locking mechanism 200 to an unlocking state, the control assembly 160 provides power to the actuator 232 to cause the actuator 232 to drive the shaft 233 in an unlocking direction. As the shaft 233 rotates the spring 236 in the unlocking direction, one or more coils 237 of the spring 236 engage the projection 235 to urge the link 234 in a corresponding unlocking direction, which in the illustrated form is toward the actuator 232. Such movement of the link 234 causes a corresponding pivoting of the blocking member 220 from its blocking position to its unblocking position.

With the blocking member 220 in its unblocking position, the locking mechanism 200 is in an unlocking state (FIG. 4). In this state, the fork member 210 is free to pivot to its pivoted position, and the lift finger 140 is therefore free to move to its actuated position under the urging of the spring mechanism 132. As such, the handle 120 is able to drive the lift finger 140 to actuate the exit device, and the trim 100 is unlocked.

In order to return the locking mechanism 200 to the locking state, the control assembly 160 provides power to the actuator 232 to cause the actuator 232 to drive the shaft 233 in a locking direction. As the shaft 233 rotates the spring 236 in the locking direction, one or more coils 237 of the spring 236 engage the projection 235 to urge the link 234 in a corresponding locking direction, which in the illustrated form is away from the actuator 232. Such movement of the link 234 pivotally urges the blocking member 220 from its unblocking position to its blocking position. Should the fork member 210 be in its pivoted position when this occurs, the shoulder 218 may prevent the blocking member 220 from returning to its blocking position. In such an event, the spring 236 elastically deforms, thereby storing the mechanical energy needed to return the blocking member 220 to its blocking position. When the fork member 210 returns to its home position, the blocking member 220 becomes free to return to its blocking position, and the spring 236 releases the mechanical energy to return the blocking member 220 to its blocking position.

Figure 5:
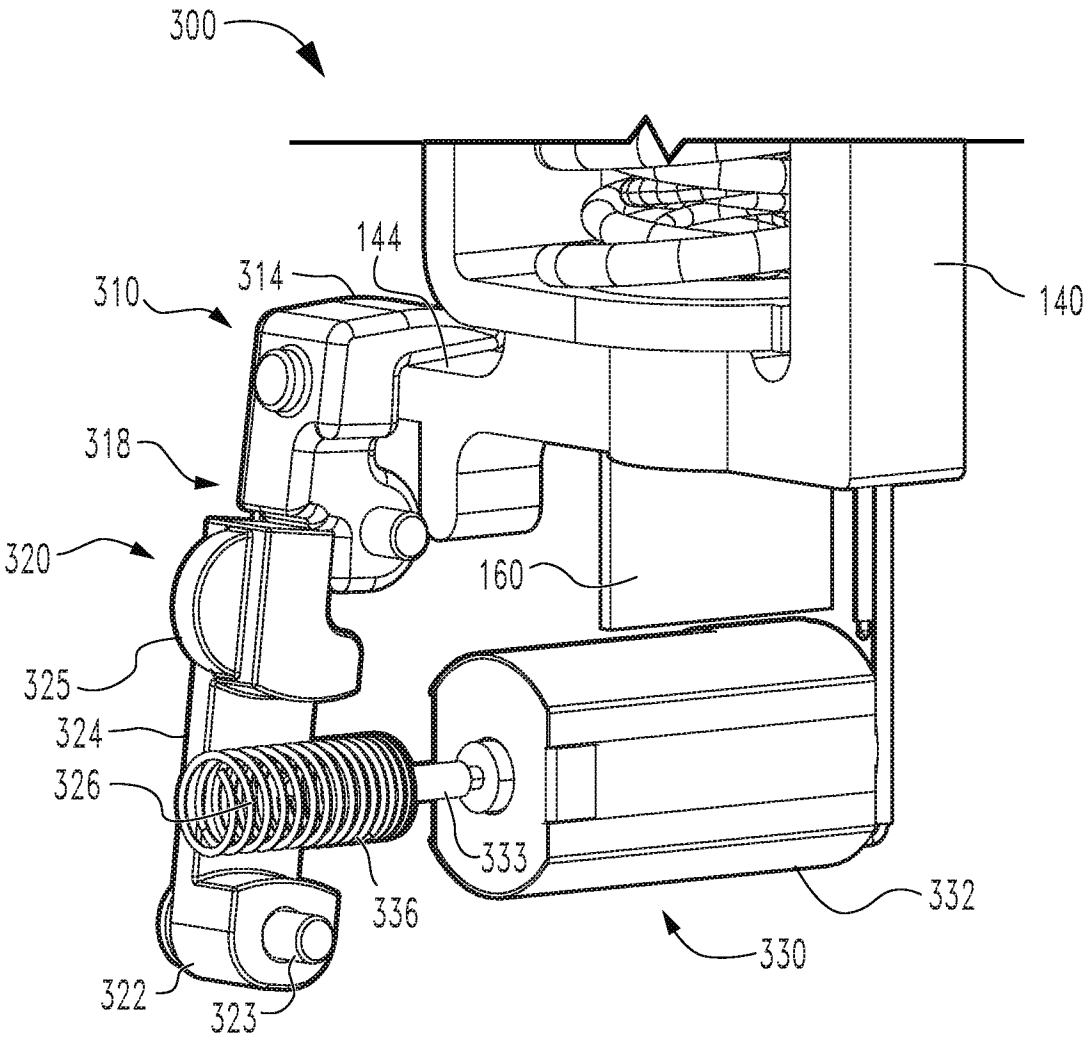
FIG. 5 is a perspective illustration of a locking mechanism according to certain embodiments while in a locking state.
Figure 6:
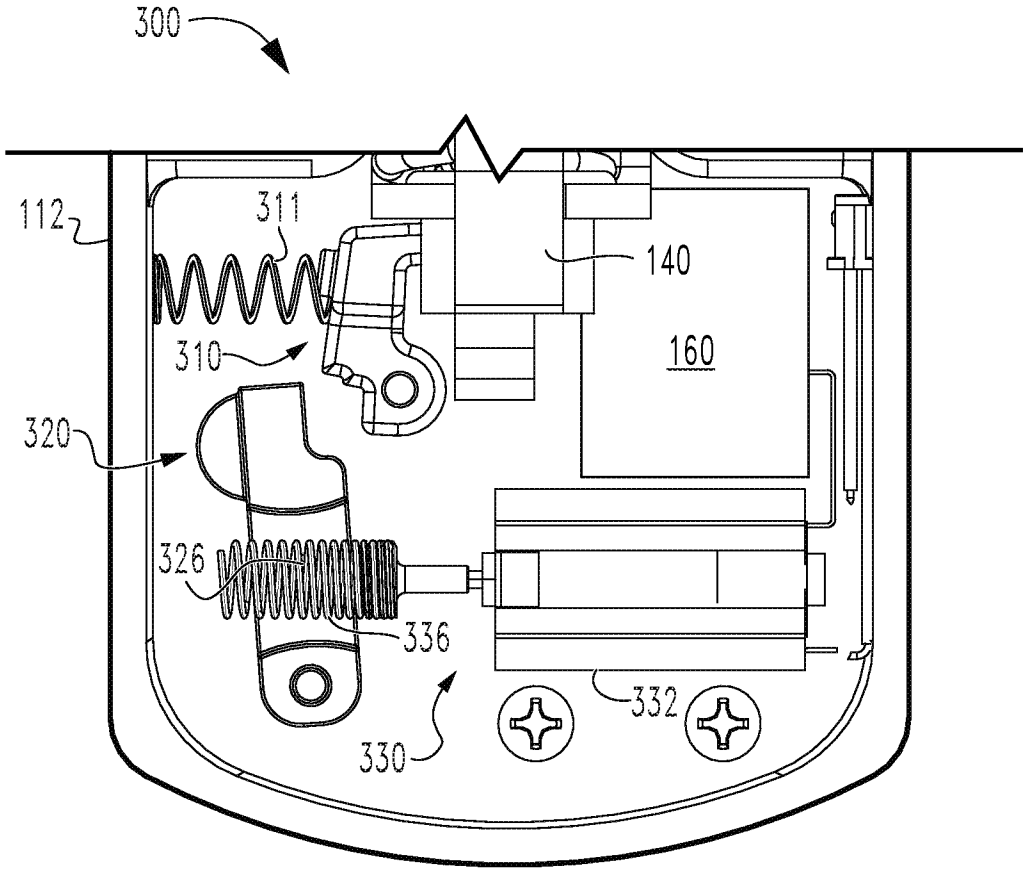
FIG. 6 is a plan view of the locking mechanism illustrated in FIG. 5 while in an unlocking state.

With reference to FIGS. 5 and 6, illustrated therein is a locking mechanism 300 according to certain embodiments. The locking mechanism 300 is another example of the locking mechanism 150, and its operation is controlled by the control assembly 160, for example in the manner described above. The locking mechanism 300 includes an interface member in the form of a hook member 310 operable to engage the lift finger 140, a blocking member 320 operable to selectively prevent movement of the hook member 310, and a driver 330 operable to drive the blocking member 320 between a blocking position and an unblocking position. In the interest of clarity, certain portions of the housing assembly 110 are omitted from the illustration of FIGS. 5 and 6. For example, an unillustrated mounting plate provides mounting locations for the pivotal mounting of the hook member 310 and the blocking member 320.

The hook member 310 is pivotably mounted within the escutcheon 112, and includes a body portion 312 through which a pivot pin 313 passes, a hook finger 314 operable to engage the ledge 144, and a shoulder 318 operable to engage the blocking member 320. The hook member 310 is biased toward a home position by a return spring 311, and is configured to pivot to an offset or pivoted position in response to movement of the lift finger 140 toward its actuated position. More particularly, movement of the lift finger 140 from its home position to its actuated position causes the ledge 144 to engage the hook finger 314 to urge the hook member 310 to its offset position against the biasing force of the return spring 311.

The blocking member 320 is pivotably mounted within the escutcheon 112, and includes a body portion 322 through which a pivot pin 323 passes, and an arm 324 extending from the body portion 322. The free end of the arm 324 defines a blocking member 325, and a projection 326 extends from an intermediate region of the arm 324.

The driver 330 includes an actuator 332 operable to move a shaft 333, and a spring 336 is mounted to the shaft 333. The actuator 332 is operable to load the spring 336 to cause the spring 336 to exert forces on the projection 326 to urge the blocking member 320 between its blocking position and its unblocking position. In the illustrated form, the spring 336 is provided in the form of a coil spring, the projection 326 extends into the spring 336 and is engaged with coils 337 of the spring 336, and the actuator 332 is configured to load the spring 336 by rotating the shaft 333. The actuator 332 may, for example, be provided in the form of a stepping motor. It is also contemplated that the actuator 332 may be a linear actuator configured to load the spring 336 by moving the shaft 333 linearly.

During operation, the locking mechanism 300 may begin in a locking state, in which the blocking member 320 is in the blocking position (FIG. 5). In this state, an attempt to move the lift finger 140 in the actuating direction causes the ledge 144 to urge the hook member 310 toward its offset or pivoted position as described above. This urging causes the shoulder 318 to engage the blocking portion 324 such that the blocking member 320 retains the hook member 310 in its home position, thereby preventing movement of the lift finger 140 toward its actuated position. As a result, the handle 120 is not operable to drive the lift finger 140 to actuate the exit device, and the trim assembly 100 is in its locked state.

In order to transition the locking mechanism 300 to an unlocking state, the control assembly 160 provides power to the actuator 332 to cause the actuator 332 to drive the shaft 333 in an unlocking direction. As the shaft 333 drives the spring 336 in the unlocking direction, one or more coils 337 of the spring 336 engage the projection 326 to urge the projection 326 in a corresponding direction, which in the illustrated form is away from the actuator 332. Such movement of the projection 326 causes a corresponding pivoting of the blocking member 320 from its blocking position to its unblocking position.

With the blocking member 320 in its unblocking position, the locking mechanism 300 is in an unlocking state (FIG. 6). In this state, the hook member 310 is free to pivot to its pivoted position, and the lift finger 140 is therefore free to move to its actuated position under the urging of the spring mechanism 132. As such, the handle 120 is able to drive the lift finger 140 to actuate the exit device, and the trim 100 is unlocked.

In order to return the locking mechanism 300 to the locking state, the control assembly 160 provides power to the actuator 332 to cause the actuator 332 to drive the shaft 333 in a locking direction. As the shaft 333 rotates the spring 336 in the locking direction, one or more coils 337 of the spring 336 engage the projection 326 to urge the projection 326 in a corresponding direction, which in the illustrated form is toward the actuator 332. Such movement of the projection 326 pivotally drives the blocking member 320 from its unblocking position to its blocking position. Should the hook member 310 be in its pivoted position when this occurs, the shoulder 318 may prevent the blocking member 320 from returning to its blocking position. In such an event, the spring 336 elastically deforms, thereby storing the mechanical energy needed to return the blocking member 320 to its blocking position. When the hook member 310 returns to its home position, the blocking member 320 becomes free to return to its blocking position, and the spring 336 releases the mechanical energy to return the blocking member 320 to its blocking position.

Figure 7:
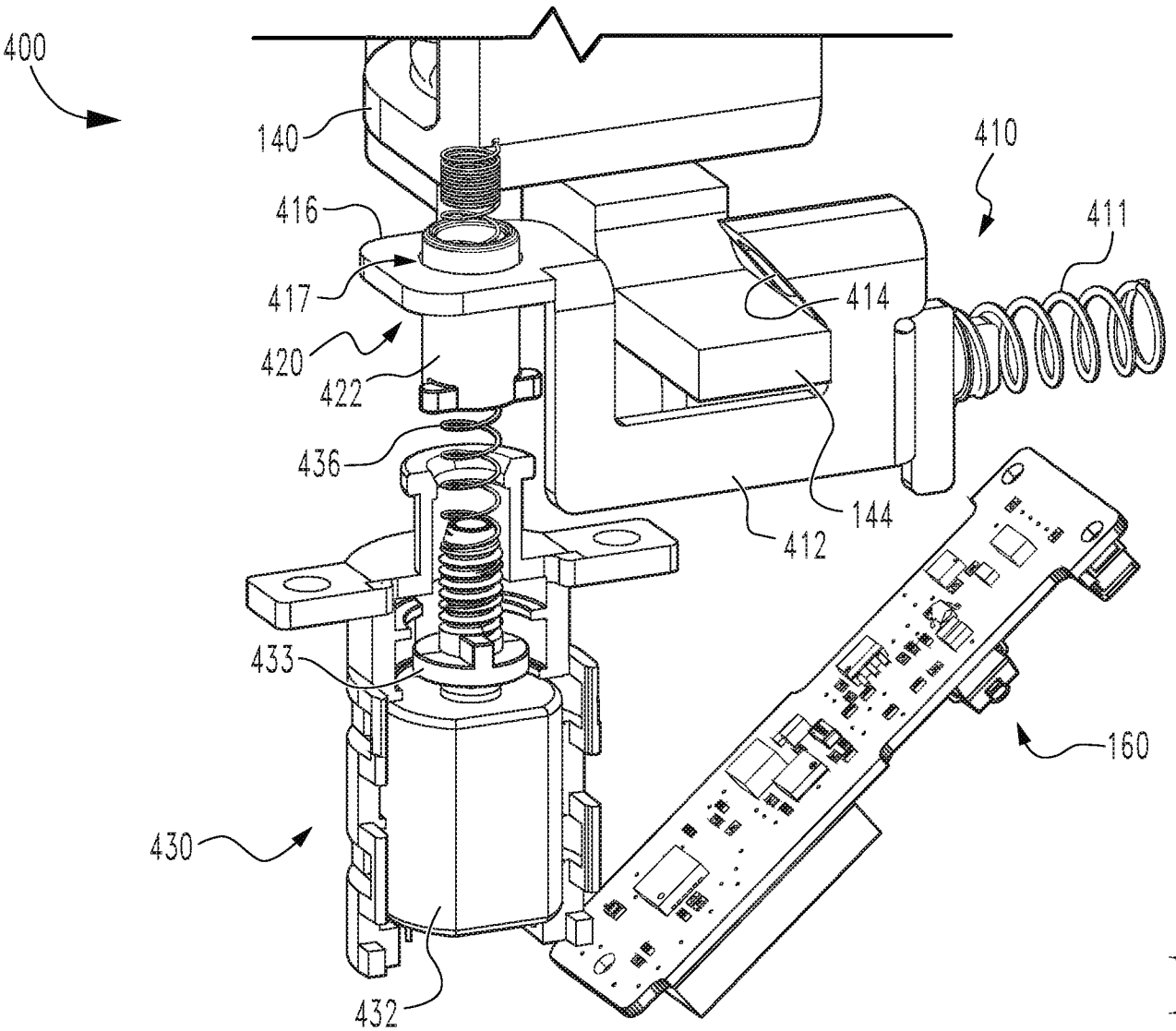
FIG. 7 is a perspective illustration of a locking mechanism according to certain embodiments while in a locking state.
Figure 8:
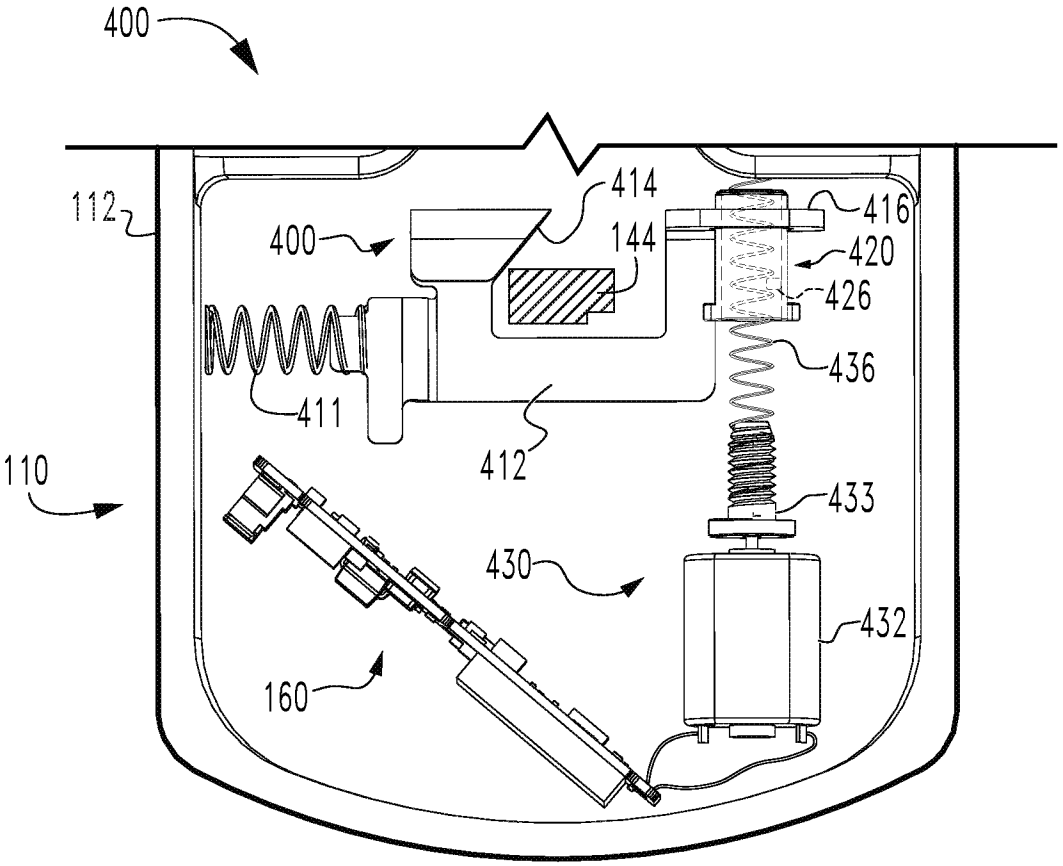
FIG. 8 is a plan view of the locking mechanism illustrated in FIG. 7 while in an unlocking state.

With reference to FIGS. 7 and 8, illustrated therein is a locking mechanism 400 according to certain embodiments. The locking mechanism 400 is a further example of the locking mechanism 150, and its operation is controlled by the control assembly 160, for example in the manner described above. The locking mechanism 400 includes an interface member in the form of a ramp member 410 operable to engage the lift finger 140, a blocking member 420 operable to selectively prevent movement of the ramp member 410, and a driver 430 operable to drive the blocking member 420 between a blocking position and an unblocking position. In the interest of clarity, certain portions of the housing assembly 110 are omitted from the illustration of FIGS. 7 and 8. For example, unillustrated portions of the housing assembly 110 constrain the ramp member 410 to horizontal movement between a home position and an offset position, and constrain the blocking member 420 to vertical movement between the blocking position and the unblocking position.

The ramp member 410 is slidably mounted within the escutcheon 112, and includes a body portion 412, a ramp 414 operable to engage the ledge 144, and a flange 416 having an opening 417 operable to receive a portion of the blocking member 420. The ramp member 410 is biased toward a home position by a return spring 411, and is configured to slide to an offset position in response to movement of the lift finger 140 toward its actuated position. More particularly, movement of the lift finger 140 from its home position to its actuated position causes the ledge 144 to engage the ramp 414 to urge the ramp member 410 to its offset position against the biasing force of the return spring 411.

The blocking member 420 is slidably mounted within the escutcheon 112, and includes a hollow body portion 422 into which a spring 436 of the driver 430 extends. Formed within the hollow body portion 422 is a projection 426 that engages the spring 436 and transmits forces between the blocking member 420 and the spring 436.

The driver 430 includes an actuator 432 operable to move a shaft 433, and a spring 436 is mounted to the shaft 433. The actuator 432 is operable to load the spring 436 to cause the spring 436 to exert forces on the projection 426 to urge the blocking member 420 between its blocking position and its unblocking position. In the illustrated form, the spring 436 is provided in the form of a coil spring, the projection 426 extends into the spring 436 and is engaged with coils 437 of the spring 436, and the actuator 432 is configured to load the spring 436 by rotating the shaft 433. The actuator 432 may, for example, be provided in the form of a stepping motor. It is also contemplated that the actuator 432 may be a linear actuator configured to load the spring 436 by moving the shaft 433 linearly.

During operation, the locking mechanism 400 may begin in a locking state, in which the blocking member 420 is in the blocking position (FIG. 7). In this state, an attempt to move the lift finger 140 in the actuating direction causes the ledge 144 to urge the ramp member 410 toward its offset position as described above. This urging causes the flange 416 to exert a horizontal force on the blocking member 420 which, as noted above, is constrained to vertical movement by the housing assembly 110. As a result, the blocking member 420 retains the ramp member 410 in its home position, thereby preventing movement of the lift finger 140 toward its actuated position. Thus, the handle 120 is not operable to drive the lift finger 140 to actuate the exit device, and the trim assembly 100 is in a locked state.

In order to transition the locking mechanism 400 to an unlocking state, the control assembly 160 provides power to the actuator 432 to cause the actuator 432 to drive the shaft 433 in an unlocking direction. As the shaft 433 drives the spring 436 in the unlocking direction, one or more coils 437 of the spring 436 engage the projection 426 to urge blocking member 420 in a corresponding direction, which in the illustrated form is toward the actuator 432. As a result, the blocking member 420 moves from its blocking position to its unblocking position.

With the blocking member 420 in its unblocking position, the locking mechanism 400 is in an unlocking state (FIG. 8). In this state, the ramp member 410 is free to slide to its offset position, and the lift finger 140 is therefore free to move to its actuated position under the urging of the spring mechanism 132. As such, the handle 120 is able to drive the lift finger 140 to actuate the exit device, and the trim 100 is unlocked.

In order to return the locking mechanism 400 to the locking state, the control assembly 160 provides power to the actuator 432 to cause the actuator 432 to drive the shaft 433 in a locking direction. As the shaft 433 drives the spring 436 in the locking direction, one or more coils 437 of the spring 436 engage the projection 426 to urge the blocking member 420 in a corresponding direction, which in the illustrated form is away from the actuator 432. Should the ramp member 410 be in its offset position when this occurs, the flange 416 may prevent the blocking member 420 from returning to its blocking position. In such an event, the spring 436 elastically deforms, thereby storing the mechanical energy needed to return the blocking member 420 to its blocking position. When the ramp member 410 returns to its home position, the blocking member 420 becomes free to return to its blocking position, and the spring 436 releases the mechanical energy to return the blocking member 420 to its blocking position.

Figure 9:
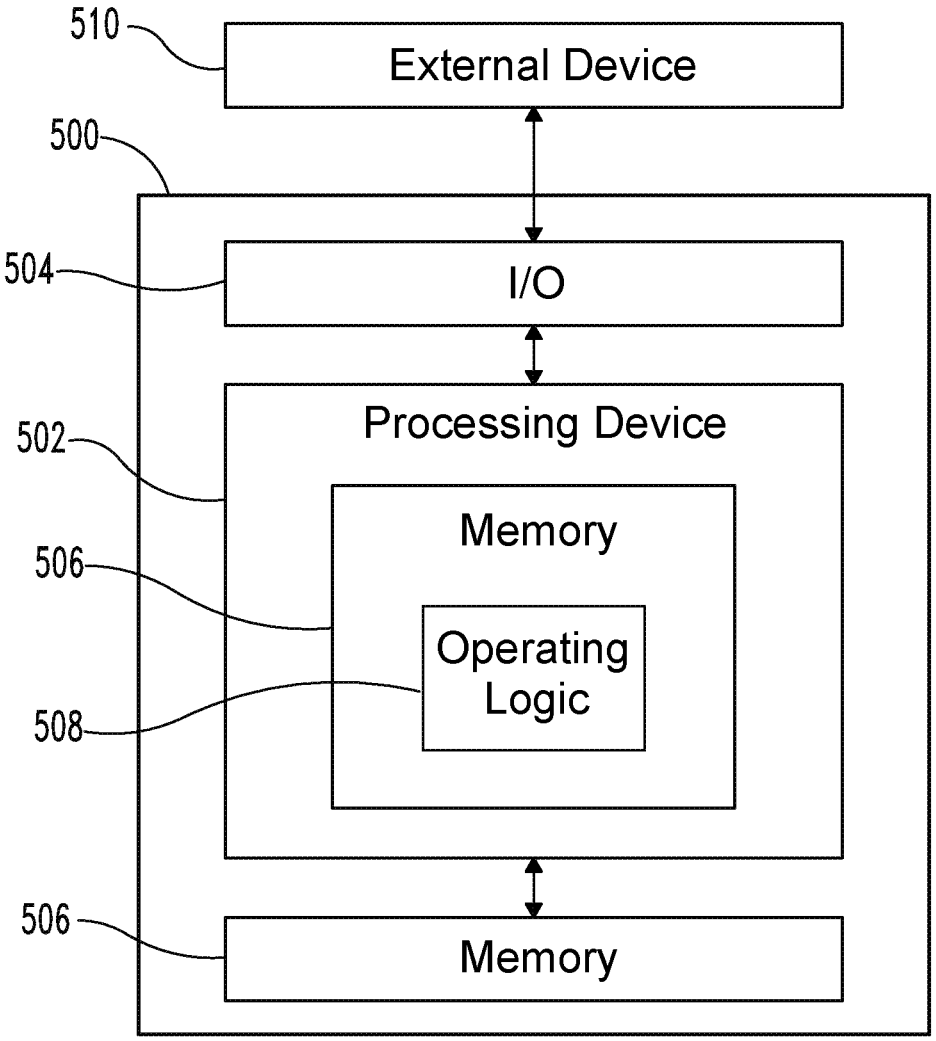
FIG. 9 is a schematic block diagram of a computing device according to certain embodiments.

FIG. 9 is a schematic block diagram of a computing device 500. The computing device 500 is one example of a computer, server, mobile device, reader device, or equipment configuration which may be utilized in connection with the control assembly 160 shown in FIG. 2. The computing device 500 includes a processing device 502, an input/output device 504, memory 506, and operating logic 508. Furthermore, the computing device 500 communicates with one or more external devices 510.

The input/output device 504 allows the computing device 500 to communicate with the external device 510. For example, the input/output device 504 may be a network adapter, network card, interface, or a port (e.g., a USB port, serial port, parallel port, an analog port, a digital port, VGA, DVI, HDMI, FireWire, CAT 5, or any other type of port or interface). The input/output device 504 may be comprised of hardware, software, and/or firmware. It is contemplated that the input/output device 504 includes more than one of these adapters, cards, or ports.

The external device 510 may be any type of device that allows data to be inputted or outputted from the computing device 500. For example, the external device 510 may be a mobile device, a reader device, equipment, a handheld computer, a diagnostic tool, a controller, a computer, a server, a printer, a display, an alarm, an illuminated indicator such as a status indicator, a keyboard, a mouse, or a touch screen display. Furthermore, it is contemplated that the external device 510 may be integrated into the computing device 500. It is further contemplated that there may be more than one external device in communication with the computing device 500.

The processing device 502 can be of a programmable type, a dedicated, hardwired state machine, or a combination of these; and can further include multiple processors, Arithmetic-Logic Units (ALUs), Central Processing Units (CPUs), Digital Signal Processors (DSPs) or the like. For forms of the processing device 502 with multiple processing units, distributed, pipelined, and/or parallel processing can be utilized as appropriate. The processing device 502 may be dedicated to performance of just the operations described herein or may be utilized in one or more additional applications. In the depicted form, the processing device 502 is of a programmable variety that executes algorithms and processes data in accordance with operating logic 508 as defined by programming instructions (such as software or firmware) stored in memory 506. Alternatively or additionally, the operating logic 508 for the processing device 502 is at least partially defined by hardwired logic or other hardware. The processing device 502 can be comprised of one or more components of any type suitable to process the signals received from input/output device 504 or elsewhere, and provide desired output signals. Such components may include digital circuitry, analog circuitry, or a combination of both.

The memory 506 may be of one or more types, such as a solid-state variety, electromagnetic variety, optical variety, or a combination of these forms. Furthermore, the memory 506 can be volatile, nonvolatile, or a combination of these types, and some or all of memory 506 can be of a portable variety, such as a disk, tape, memory stick, cartridge, or the like. In addition, the memory 506 can store data that is manipulated by the operating logic 508 of the processing device 502, such as data representative of signals received from and/or sent to the input/output device 504 in addition to or in lieu of storing programming instructions defining the operating logic 508, just to name one example. As illustrated, the memory 506 may be included with the processing device 502 and/or coupled to the processing device 502.

The processes in the present application may be implemented in the operating logic 508 as operations by software, hardware, artificial intelligence, fuzzy logic, or any combination thereof, or at least partially performed by a user or operator. In certain embodiments, units represent software elements as a computer program encoded on a non-transitory computer readable medium, wherein the control assembly 160 performs the described operations when executing the computer program.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A trim assembly, comprising:

a housing assembly;

a cam rotatably mounted to the housing assembly;

a lift finger slidably mounted in the housing assembly, wherein the lift finger is engaged with the cam such that the cam is operable to linearly drive the lift finger between a deactuated position and an actuated position;

an interface member pivotally mounted in the housing assembly, wherein the interface member is engaged with the lift finger such that movement of the lift finger between the deactuated position and the actuated position moves the interface member between a home position and an offset position;

a blocking member movably mounted in the housing assembly, the blocking member having a blocking position in which the blocking member retains the interface member in the home position to thereby retain the lift finger in the deactuated position, the blocking member having an unblocking position in which the blocking member permits movement of the interface member between the home position and the offset position to thereby permit movement of the lift finger between the deactuated position and the actuated position; and an electrically-operable driver mounted in the housing and engaged with the blocking member, wherein the driver is configured to move the blocking member between the blocking position and the unblocking position to thereby lock and unlock the trim assembly.

2. The trim assembly of claim 1, wherein the driver comprises an electric actuator and a spring engaged between the actuator and the blocking member, and wherein the actuator is configured to load the spring such that the spring urges the blocking member to move between the blocking position and the unblocking position.

3. The trim assembly of claim 2, wherein the spring is a coil spring, wherein the trim assembly further comprises a projection extending into the coil spring such that the projection is received between coils of the coil spring, and wherein the projection is engaged with the blocking member to transmit forces between the coil spring and the blocking member.

4. The trim assembly of claim 3, wherein the actuator is configured to load the coil spring by rotating the coil spring, thereby causing coils of the coil spring to engage the projection.

5. The trim assembly of claim 2, wherein the actuator is a linear actuator and is configured to load the spring by exerting a linear force on the spring.

6. The trim assembly of claim 1, further comprising a control assembly including a controller and an energy storage device, wherein the controller is operable to actuate the driver using electrical energy stored by the energy storage device.

7. The trim assembly of claim 6, wherein the control assembly is operable to receive power from an external device, and wherein the control assembly is further configured to:

charge the energy storage device to a threshold charge using the power;

actuate the driver in a first manner to urge the blocking member to a first position; and in response to power from the external device terminating, actuate the driver in a second manner to urge the blocking member to a second position; and wherein the first position is one of the blocking position or the unblocking position, and wherein the second position is the other of the blocking position or the unblocking position.

8. The trim assembly of claim 1, wherein the blocking member is pivotably mounted to the housing assembly.

9. The trim assembly of claim 1, wherein the interface member is biased toward the home position.

10. The trim assembly of claim 1, further comprising a projection operable to transmit forces between the blocking member and a coil spring of the driver;

wherein the projection is received between coils of the coil spring such that rotation of the coil spring urges the projection to drive the blocking member between the blocking position and the unblocking position; and wherein the driver further comprises a rotary motor operable to rotate the coil spring.

11. The trim assembly of claim 10, wherein the blocking member includes the projection.

12. The trim assembly of claim 10, further comprising a link including the projection; and wherein the link is engaged with the blocking member.

13. The trim assembly of claim 1, wherein the interface member is configured to pivot between the home position and the offset position;

wherein the interface member includes a shoulder; and wherein the blocking member engages the shoulder when in the blocking position and thereby prevents pivoting of the interface member to the offset position.

14. The trim assembly of claim 1, further comprising a slider and a spring mechanism mounted to the slider; and wherein the lift finger is engaged with the cam mechanism via the slider and the spring mechanism.

15. A trim assembly, comprising:

a housing assembly;

a cam rotatably mounted to the housing assembly;

a lift finger slidably mounted in the housing assembly, wherein the lift finger is engaged with the cam such that the cam is operable to linearly drive the lift finger between a deactuated position and an actuated position;

an interface member movably mounted in the housing assembly, wherein the interface member is engaged with the lift finger such that movement of the lift finger between the deactuated position and the actuated position moves the interface member between a home position and an offset position;

a blocking member movably mounted in the housing assembly, the blocking member having a blocking position in which the blocking member retains the interface member in the home position to thereby retain the lift finger in the deactuated position, the blocking member having an unblocking position in which the blocking member permits movement of the interface member between the home position and the offset position to thereby permit movement of the lift finger between the deactuated position and the actuated position;

an electrically-operable driver mounted in the housing and engaged with the blocking member, wherein the driver is configured to move the blocking member between the blocking position and the unblocking position to thereby lock and unlock the trim assembly; and a control assembly including a controller and an energy storage device, wherein the controller is operable to actuate the driver using electrical energy stored by the energy storage device, and wherein the control assembly further comprises a switch operable to transition the control assembly between a first mode and a second mode;

wherein in the first mode, the driver is actuated in a first manner to urge the blocking member to a first position; and wherein in the second mode, the driver is actuated in a second manner to urge the blocking member to a second position.

16. A trim assembly, comprising:

a housing assembly;

a cam rotatably mounted to the housing assembly;

a lift finger slidably mounted in the housing assembly, wherein the lift finger is engaged with the cam such that the cam is operable to linearly drive the lift finger between a deactuated position and an actuated position;

an interface member movably mounted in the housing assembly, wherein the interface member is engaged with the lift finger such that movement of the lift finger between the deactuated position and the actuated position moves the interface member between a home position and an offset position;

a blocking member movably mounted in the housing assembly, the blocking member having a blocking position in which the blocking member retains the interface member in the home position to thereby retain the lift finger in the deactuated position, the blocking member having an unblocking position in which the blocking member permits movement of the interface member between the home position and the offset position to thereby permit movement of the lift finger between the deactuated position and the actuated position, wherein the interface member is configured to urge the blocking member in response to movement of the lift finger from the actuated position toward the deactuated position; and an electrically-operable driver mounted in the housing and engaged with the blocking member, wherein the driver is configured to move the blocking member between the blocking position and the unblocking position to thereby lock and unlock the trim assembly.

17. The trim assembly of claim 16, wherein the blocking member in the blocking position is operable to move in a first direction toward the unblocking position;

wherein the interface member is configured to urge the blocking member in a second direction in response to movement of the lift finger from the actuated position toward the deactuated position; and wherein the second direction is orthogonal to the first direction.

18. A trim assembly, comprising:

a housing assembly;

a cam rotatably mounted to the housing assembly;

a lift finger slidably mounted in the housing assembly, wherein the lift finger is engaged with the cam such that the cam is operable to linearly drive the lift finger between a deactuated position and an actuated position;

an interface member movably mounted in the housing assembly, wherein the interface member is engaged with the lift finger such that movement of the lift finger between the deactuated position and the actuated position moves the interface member between a home position and an offset position;

a blocking member slidably mounted to the housing assembly, the blocking member having a blocking position in which the blocking member retains the interface member in the home position to thereby retain the lift finger in the deactuated position, the blocking member having an unblocking position in which the blocking member permits movement of the interface member between the home position and the offset position to thereby permit movement of the lift finger between the deactuated position and the actuated position; and an electrically-operable driver mounted in the housing and engaged with the blocking member, wherein the driver is configured to move the blocking member between the blocking position and the unblocking position to thereby lock and unlock the trim assembly.

19. The trim assembly of claim 18, wherein the interface member is slidably mounted to the housing assembly and is configured to slide between the home position and the offset position;

wherein the interface member includes an opening; and wherein the blocking member is received in the opening when in the blocking position and thereby prevents sliding movement of the interface member to the offset position.

20. The trim assembly of claim 18, wherein the interface member is slidably mounted to the housing assembly.

* * * * *